United States Patent [19]

Nettles, et al.

[11] Patent Number: 4,784,337

[45] Date of Patent: Nov. 15, 1988

[54] REVERSIBLE KNIFE ASSEMBLY FOR WOOD CHIPPER

[75] Inventor: Timothy P. Nettles, Carthage; Mark Robinson, Black River, both of N.Y.

[73] Assignee: Carthage Machine Company, Div. of Industrial General Corporation, Carthage, N.Y.

[21] Appl. No.: 99,309

[22] Filed: Sep. 21, 1987

[51] Int. Cl.[4] ..... B02C 18/18

[52] U.S. Cl. ..... 241/92; 144/176; 144/241

[58] Field of Search ..... 241/92, 298; 144/176 X, 144/174, 162 R, 241 X

[56] References Cited

U.S. PATENT DOCUMENTS 4,503,893 3/1985 Demopoulos ..... 241/92 X 4,694,995 9/1987 Holmberg et al. ..... 241/92

*Primary Examiner*—Carl E. Hall

*Assistant Examiner*—Joseph M. Gorski

*Attorney, Agent, or Firm*—Wall and Roehrig

[57] ABSTRACT

A chipper for cutting uniform chips from a log having a rotating disc containing a plurality of radially disposed cutting stations, each having a knife assembly positioned adjacent a chip slot. Each knife assembly has an elongated cassette having a knife receiving recess formed in the top front surface thereof. A reversible knife is located in the recess by means of a key and is held in place by a retaining bar so that one cutting edge of the knife is accurately positioned at the entrance to the chip slot. Reversing the knife in the cassette after the first edge becomes dulled similarly positions the second cutting edge. Preferably, a plurality of knives are mounted end to end in the cassette.

18 Claims, 2 Drawing Sheets

REVERSIBLE KNIFE ASSEMBLY FOR WOOD CHIPPER

BACKGROUND OF THE INVENTION

This invention relates to a disc-type chipper for cutting uniform chips from a log, and in particular, to an improved blade mounting assembly for supporting reversible knife blades upon the front face of the disc.

In U.S. Pat. No. 4,047,670 to Svensson there is disclosed a disc type chipper that employs reversible type knives. The blade of each knife has a Z-shaped configuration having angularly disposed cutting surfaces that makes the blade extremely difficult to grip and support in assembly. The knives are clamped between a lower chip guide and an upper clamping bar which have precisely machined jaws capable of accepting the complex shape of the blade therebetween. In assembly the jaws are arranged to clamp upon the center leg of one or more blades. Because of the complex blade geometry, the blades can easily become misaligned between the jaws during the clamping operation. Typically, Svensson utilizes at least two blades in each cutting station. The blades are provided in short segments and are mounted end to end between the clamping jaws in assembly. Accordingly, the blade alignment and clamping problems become compounded when the jaws are being closed.

Due to the odd configuration of the Svensson knife blades, both the blades themselves and the clamping jaws are difficult and costly to manufacture. The center leg which supports the two offset and angularly disposed cutting edges represents a weak sector and is subject to failure under load or extended use. Accordingly, both initial cost of a chipper using these reversible knives and the cost of operating and maintaining the machines are relatively high.

SUMMARY OF THE INVENTION

It is therefore an object of this invention to improve disc type chippers for cutting uniform chips from a log.

It is a further object of the present invention to provide an improved double edge knife and knife holder for use in disc type chippers.

A still further object of the present invention is to provide a knife unit for a disc type chipper that uses reversible double edged knives that can be easily and accurately reversed in assembly.

Another object of the present invention is to more positively secure reversible blades in a disc type chipper.

Yet another object of the present invention is to provide an easily installed cassette for supporting a series of reversible knives in radial alignment in a disc type chipper.

While it is still another object of the present invention to provide a cassette supporting a plurality of knives in end to end alignment within a disc type chipper, and which is automatically positioned in assembly to locate the cutting edge of each knife at a desired cutting position.

A still further object of the present invention is to reduce the initial cost of a disc type chipper using reversible cutting knives and the cost of operating and maintaining the machine.

These and other objects of the present invention are attained by disc type chipper having a plurality of radially disposed knife assemblies secured to the front face of a rotating disc adjacent to the entrance of spaced radial extended chip slots which pass axially through the disc. Each knife assembly includes a cassette having a knife receiving recess formed in its top front surface and raised key that extends along the length of the recess. One or more double edged reversible knife blades are seated in the recess. Each blade is trapezoidal in shape and has a keyway formed in its base for receiving the key therein. The key locates the blade in assembly to position one of its cutting edges in the entrance to the chip slot. A retaining bar is also located in the recess behind the blade or blades and has a slanted side wall that bears against other cutting edges of the blade or blades. The bar is secured to the cassette by means of threaded fasteners thereby locking the blade or blades in the cassette.

The cassette is seated within a groove formed in a cassette holder with the back of the cassette being indexed against the back wall of the groove. A clamping member is movably mounted in the disc below the cassette receiving groove and is arranged to move into locking contact against the cassette to clamp the cassette and the knife blades contained therein against the cassette holder.

BRIEF DESCRIPTION OF THE DRAWINGS

For a better understanding of these and other objects of the present invention, reference is had to the following detailed description of the invention that is to be read in conjunction with the accompanying drawings, wherein.

DESCRIPTION OF THE INVENTION

Figure 1:
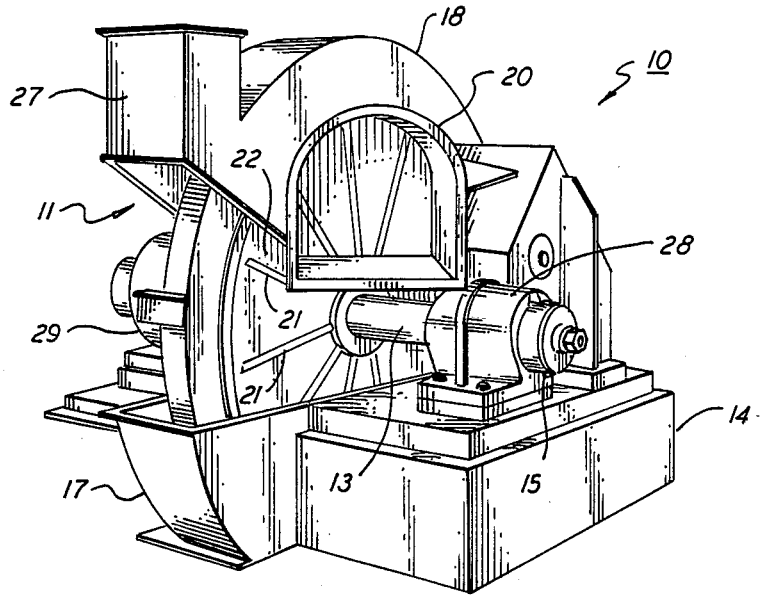
FIG. 1 is a perspective view of a disc type chipper for cutting uniform chips from a log.
Figure 2:
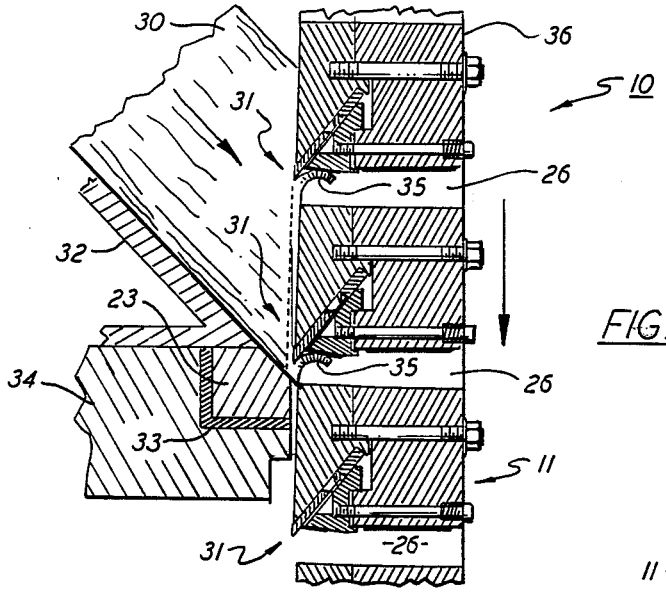
FIG. 2 is a partial sectional view taken through the disc of the chipper shown in FIG. 1 further illustrating a log being fed into a series of disc mounted cutting stations.

Referring initially to FIGS. 1 & 2, there is illustrated a large disc-type log chipper 10 of the well-known Carthage-Norman design. The chipper includes a vertically disposed disc 11 that is secured for rotation upon a horizontal drive shaft 13. The drive shaft is mounted in a base 14 by suitable journal bearing assemblies, one of which is depicted at 15. The lower part of the disc is shielded by a protective cover 17 while the top part is enclosed within a removable hood 18. A portion of the hood has been removed in FIG. 1 to better show the construction of the disc. An over-the-shaft horizontal log feeder 20 passes through the hood and permits logs to be chipped to be fed into a series of radially extended cutting knives 21-21. As will be explained in greater detail below, the knife blades are clamped to the face 22 of the disc within spaced apart cutting stations. The feeder 20, includes a stationary bedknife 23 (FIG. 2) that cooperates with the moving knives 21-21 to cut a log 30 into uniformly sized chips that are suitable for use in a digester of the type employed in a conventional wood pulping process.

Typically, 12 to 15 cutting stations are equally spaced about the face of the disc at the entrance to radially disposed chip slots 26 which pass axially through the disc. The chips, as they are cut from a log, are directed through the chip slots and are ejected from the machine via a tangential exhaust chute 27. The drive shaft of the chipper is coupled to a drive motor 28 which turns the disc at an operating speed which is high enough to cause all the chips to be expelled from the machine through the chute. A flywheel 29 is coupled to the shaft whereby maximum power derived by the motor can be converted at the shaft to work for efficiently cutting chips.

FIG. 2 shows a plurality of cutting stations 31-31 acting simultaneously upon an incoming log 30. The log is shown seated in the feeder 20 upon a spout 32 that leads to a stationary bedknife 31. The bedknife is housed in a liner 33 and fixed to the front frame 34 of the feeder. As the cutting knives 21-21 are moved past the bedknife at high speed, chips 35-35 are rapidly cut from the face of the log. The chips are, in turn, directed into the adjacent chip slots 26-26 and passed out the back 36 of the disc. Under the influence of the rotating disc, the chips are hurled into the chute 27 and exhausted from the machine.

Figure 3:
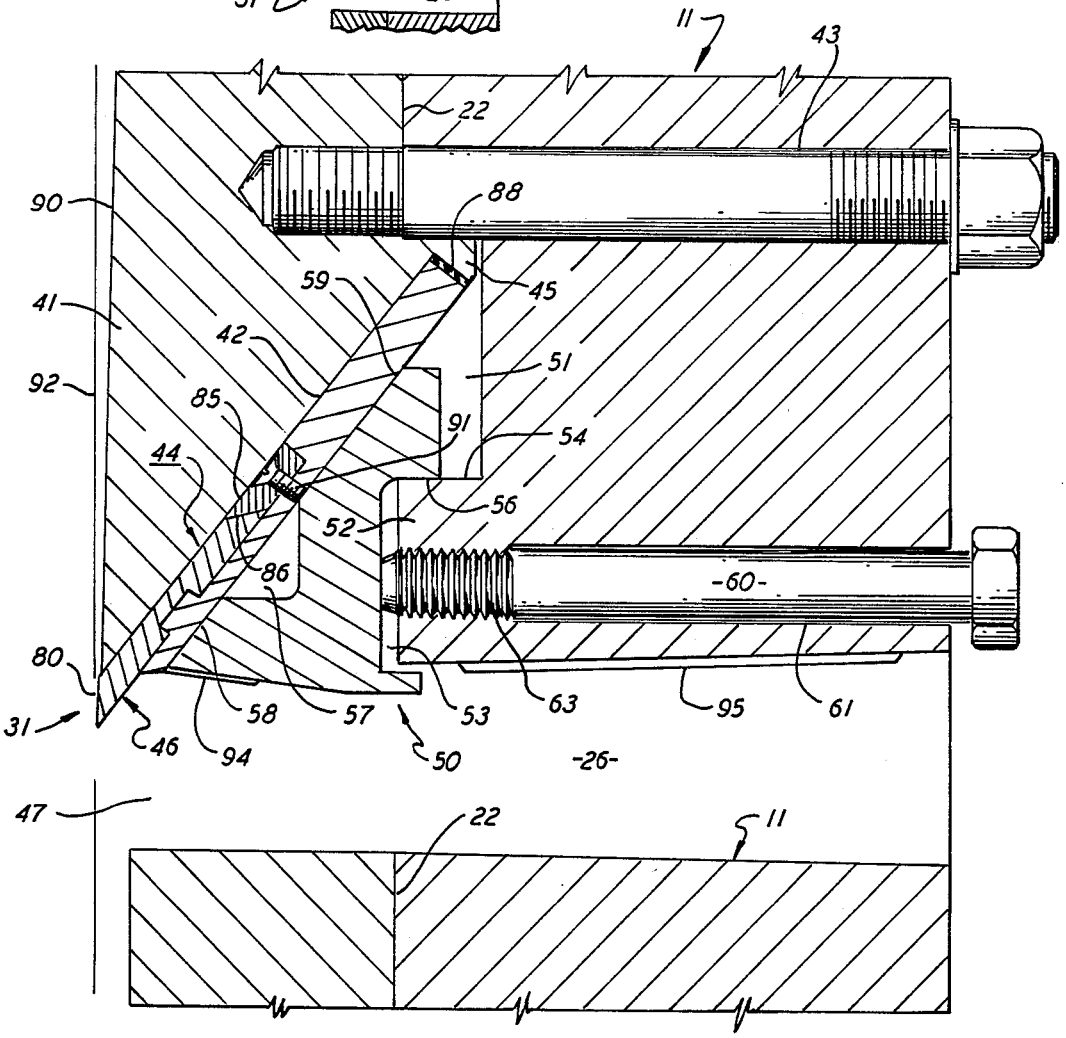
FIG. 3 is an enlarged view of one of the cutting stations illustrated in FIG. 2.

Turning now to FIG. 3 there is illustrated an enlarged view in sections of one of the cutting stations which, as noted above, is generally referenced 31. Each station includes a stationary knife holder 41 that is secured to the vertical front face 22 of the disc 11 by means of studs 43. A knife assembly, 44 which shall be described in greater detail below, is mounted at an angle of between 30 degrees and 40 degrees with axis of the disc in an L-shaped groove formed in the bottom of the knife holder adjacent to the chip slot. The groove opens into the entrance 47 of the chip slot and includes an upper clamping surface 42 that is arranged to contact the top of the knife assembly and a back wall 45 against which the rear portion of the knife assembly is seated. The knife assembly includes a series of longitudinally aligned knife blades 46 that project outwardly and upwardly into the entrance region of the chip slot.

A bifurcated clamping member 50 is movably supported in the disc and is adapted to act upon the bottom of the knife assembly to hold it securely in the groove of the stationary knife holder. A recess 51 is formed in the face of the disc to provide a raised shoulder 52 along the rim of the chip slot. An opposing groove 53 is formed in the bottom of the clamping member for receiving the shoulder therein. The back face 54 of the groove in assembly rides in sliding contact against the rear surface 56 of the shoulder to guide the champing member toward and away from the knife assembly. The bifurcated front face of the clamping member is inclined to complement the incline of the groove formed in the opposing stationary knife holder. A cutout 57 divides the face of the movable clamping member into two lower clamping surfaces 58 and 59 that are arranged to bear independently against the bottom of the knife assembly and apply a locking pressure thereto. A series of clamping bolts 60 are adjustably supported by threads 63 within receiving holes 61 spaced about disc 11. The distal end of each bolt rests against the bottom surface of the clamping member 50. Turning the bolts in one direction urges the clamping member into contact against the knife cassette to clamp the knife assembly against the knife holder 41 and thus securely mount the knife assembly in the disc. To remove the knife assembly from the disc, the bolts are loosened to a point where the knife assembly can be slipped out of the disc, and the blade 46 either replaced or reversed in the assembly.

Figure 4:
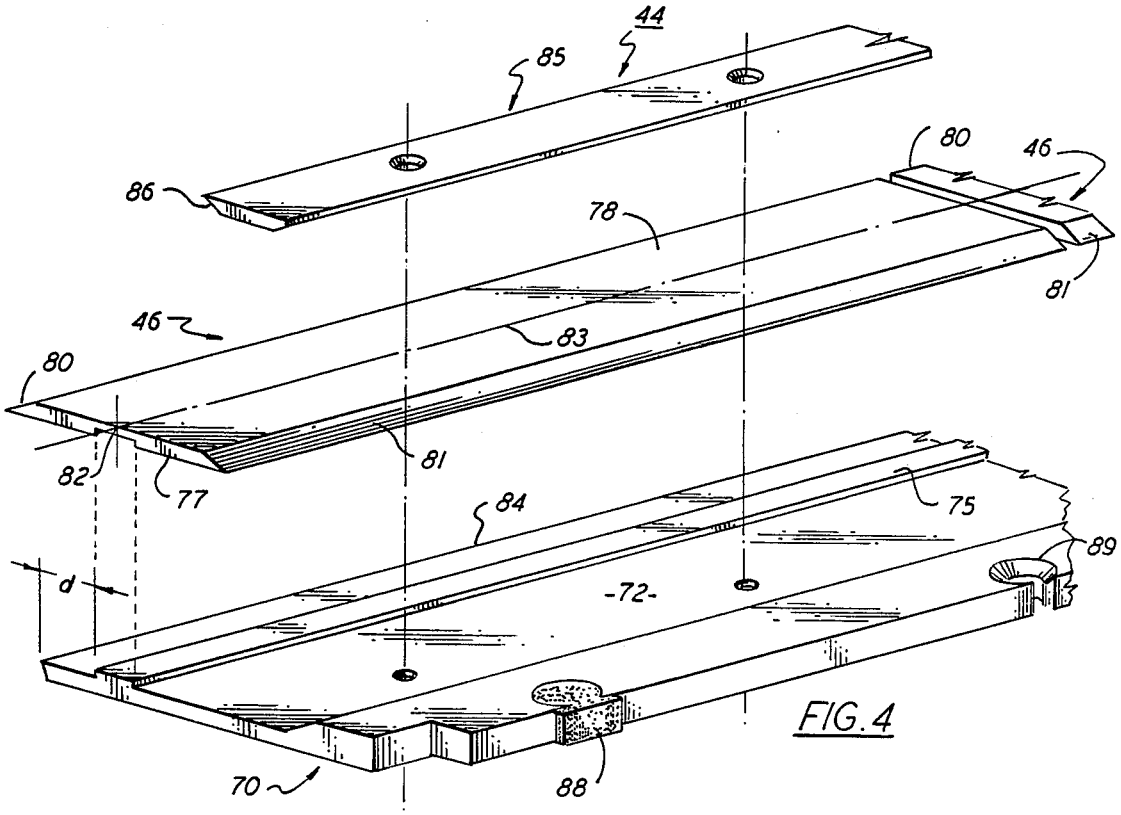
FIG. 4 is an enlarged exploded view in perspective showing the component parts of the knife assembly used in each of the cutting stations.

Turning now to FIG. 4, there is shown the previously noted knife assembly 44 in which a series of cutting knives 46-46 are reversibly mounted. The assembly includes an elongated knife cassette 70. The cassette has a recess 72 cut into its top front surface for housing the knife blades. A raised key 75 is contained in the floor of the recess which extends laterally across the length of the cassette. Although a flat key is shown in this embodiment of the invention, any suitably shaped key may be used in the practice of the invention.

The flat knife blades 46-46 are seated in abutting end to end relationship within the recess. Each blade is trapezoidal in cross section with the base 7 being wider than the parallel top surface 78. A pair of bevelled cutting edges 80 and 81 are located at the front and back of each knife blade. The blades are made of quality steel and the cutting edges are finely honed to provide a keen edge capable of efficiently cutting chips from a log. A lateral keyway 82 is cut into the base of each blade and extends along the entire length of the blade. The shape of the keyway complements that of the key 75 and has a close running fit with the key to accurately seat the blades in the recess. The keyway is centered upon the central axis 83 of the blade so that each cutting edge is positioned the same distance from the center of the keyway. The key is located a predetermined distance (d) from the front edge 84 of the cassette. Accordingly, the forward cutting edge of each knife blade seated in the recess protrudes outwardly the same distance from the edge 84 of the cassette at a desired location. Reversing any blade in the cassette will automatically cause the opposite cutting edge of the blade to be positioned at the desired location within the entrance region 47 to the chip slot (FIG. 3).

With further reference to FIGS. 3 and 4, a retaining bar 85 is mounted in the recess 72 behind the knife blade. The bar is held in place by counter-sunk screws 91 (FIG. 3). The bar is generally trapezoidal shaped, with its front face 86 being inclined at about the same angle as the bevelled cutting edges of the knife blades. Preferably, this angle is somewhere between 30 degrees and 40 degrees. As seen in FIG. 3, the inclined face of the bar is clamped in assembly against the complementary back cutting edge of each knife blade contained within the cassette recess. The locking action of the retaining bar coupled with that of the key serves to properly locate and hold the blades in the cassette so that they cannot become misaligned or otherwise misadjusted in assembly.

Babbitt pads 88 are secured to the back of the cassette. The pads are arranged to rest in contact against the back wall 45 of the receiving groove formed in the stationary knife holder. The pads are poured from babbitt which is flowed at the time of pouring into suitable anchor holes 89 (FIG. 4) spaced along the back of the cassette. The pads are accurately formed to a desired thickness and serve in assembly to accurately position the extended cutting edges 80 of the knife blades at the desired location within the entrance to the chip slot. In practice the cutting edge of the blade 80 passes outwardly through the entrance region and protrudes slightly beyond the top surface 90 of the stationary knife holder.

Each knife blade has a thickness that is the same as the depth of the recess contained in the cassette. Accordingly, when the bifurcated clamping member is moved upwardly toward the stationary member the cassette and the knife blades are securely locked between the two members.

In assembly, the bevelled surface of cutting edge 80 is generally positioned in parallel relationship with the front face 22 of the disc with the surfaces of the blades lying in a common plane 92 referred to as the "silver ring." The top surface 90 of each stationary knife holder is inclined downwardly away from the silver ring to provide a back rack for the knives to allow the knives to move smoothly through the wood without binding. A wear resistant facing 94 is mounted on the front of each clamping member beneath the knife blades so that chips entering the chip slot strike the facing and thus prevents excessive wear on the member. A stainless steel liner 95 is similarly mounted in each chip slot downstream from the facing to protect the slot wall where it is most susceptible to wear.

As should be evident from the above disclosure, the knife supporting structure of the present invention enables the reversible knife blades mounted in each cassette to be quickly and safely changed in assembly thus minimizing machine down time. By the same token, the flat blades are better able to resist shock than the reversible blades shown in the prior art. The flat blade shape is also less costly to fabricate and, through use of the disclosed cassette, can be more positively clamped and locked in the present assembly.

While this invention has been described with specific reference to the structure disc above, the invention is not necessarily limited to this structure and encompasses any structure that may come within the scope of the following claims.

What is claimed is:

1. Apparatus for cutting chips from a log, having a plurality of radially disposed knife assemblies secured to the front face of a rotating disc adjacent to the entrance of spaced chip slots that pass axially through the disc, each knife assembly including an elongated cassette having a knife receiving recess formed in the top front surface thereof adjacent to a chip slot, at least one flat double edged knife blade seated in said chip slot, having a top surface that is coplanar with the top surface of the cassette, a keying means acting between the cassette and the knife blade for locating the blade in the recess with one of the cutting edges protruding beyond the front surface of the cassette into the entrance region of an adjacent chip slot, a knife retaining bar mounted in the recess behind the blade having an inclined surface that is seated in contact against the other cutting edge of the blade, and means to removably secure the retaining bar to the cassette to secure the blade within said recess.

2. The apparatus of claim 1 that further includes a cassette holding member stationarily secured to the disc, and a clamping member movably mounted within the disc, said members having coacting clamping surfaces for securing the cassette therebetween.

3. The apparatus of claim 2 wherein the top surface of at least one blade and the top surface of the cassette are clamped against the cassette holding member.

4. The apparatus of claim 2 wherein said clamping member is bifurcated to provide a plurality of clamping surfaces arranged to bear independently against the bottom surface of the cassette.

5. The apparatus of claim 2 wherein said movable clamping member further includes a threaded member for moving the clamping member toward and away from the cassette holding member.

6. The apparatus of claim 1 that further includes a plurality of blades seated in end to end alignment in said cassette.

7. The apparatus of claim 6 wherein each of the blade cutting edges is bevelled at an angle from the top surface of the blade toward its base.

8. The apparatus of claim 7 wherein the cutting edge angle is between 30 degrees and 40 degrees.

9. The apparatus of claim 1 wherein the keying means is centered upon a central axis of the blade.

10. The apparatus of claim 1 wherein the cassette has a series of spaced anchor means located along its back section and a series of locating pads are secured in said anchor means which protrude a predetermined distance behind the cassette.

11. The apparatus of claim 10 wherein said cassette holding member has a locating shoulder formed therein against which the locating pads are seated.

12. Apparatus for cutting chips from a log that includes a disc having a series of spaced radially disposed chip slots passing axially therethrough, a stationary member secured to the front face of the disc adjacent each of the slots, said stationary member having an L-shaped inclined groove formed in its bottom surface that opens into the entrance of a chip slot, an elongated knife holding cassette seated in said groove having a recess formed in its top front surface for receiving a series of trapezoidal shaped knife blades in end to end alignment therein, said recess having a raised elongated key extending laterally along its length that is received within a keyway formed in the base of each of said blades contained within said recess, each of said knife blades further including bevelled cutting edges along the opposing side faces thereof whereby the blades can be reversed in the cassette, a retaining bar removably secured in the recess of the cassette behind the knife blades having a slanted surface that overlie the rear cutting edge of each blade to retain the blades in the cassette, with the front cutting edge of each blade extending outwardly from the cassette into the entrance region of the chip slot, a movable member movably supported in the disc beneath the groove formed in the stationary member that includes at least one clamping surface arranged to contact the bottom of the cassette, and means operable to move the movable member into locking contact against the cassette to securely hold the cassette within the groove of the stationary member.

13. The apparatus of claim 12 wherein the keyway is centered along a central axis of each knife blade.

14. The apparatus of claim 12 wherein the groove in the stationary member is inclined upwardly toward the entrance of the chip slot at an angle with the axis of the disc that is substantially equal to the bevel angle of the blade cutting edges.

15. The apparatus of claim 14 wherein the front cutting edge of each knife blade protrudes upwardly and outwardly beyond the top surface of the stationary member and said top surface is provided with a back rack angle so that it slants downwardly away from the protruding edge of the blade.

16. The apparatus of claim 12 wherein the thickness of the knife blades are substantially equal to the depth of the cassette recess.

17. The apparatus of claim 12 wherein the cassette further includes a plurality of locating pads secured to its back surface that are arranged to seat in contact against the back wall of the groove formed in the stationary member.

18. The apparatus of claim 12 wherein the movable member is bifurcated to provide a pair of clamping surfaces arranged to independently bear upon the bottom of the cassette.

* * * * *